US005803968A

United States Patent [19]

Schwartz et al.

[11] Patent Number: 5,803,968

[45] Date of Patent: Sep. 8, 1998

[54] COMPACT DISC SPIN COATER

[76] Inventors: Vladimir Schwartz, 12 Revolutionary Rd.; Michael Schwartz, 314 Bedford St., both of Lexington, Mass. 02173; Klaus Bierwagen, 45 Wadsworth Ave., Waltham, Mass. 02154

[21] Appl. No.: 517,388

[22] Filed: Aug. 21, 1995

[51] Int. Cl.[6] ..... B05C 11/02

[52] U.S. Cl. ..... 118/52; 118/56; 118/500; 118/730; 427/240

[58] Field of Search ..... 118/52, 56, 500, 118/730; 427/240; 220/336, 367.1

[56] References Cited

U.S. PATENT DOCUMENTS

| | | | |
|---|---|---|---|
| 943,407 | 12/1909 | Heimbuecher | 220/336 |
| 1,159,198 | 11/1915 | Elliott | 220/336 |
| 4,033,288 | 7/1977 | Woellhaf et al. . | |
| 4,068,019 | 1/1978 | Boeckl . | |
| 4,073,262 | 2/1978 | Scheffel et al. . | |
| 4,086,870 | 5/1978 | Canavello et al. . | |
| 4,113,492 | 9/1978 | Sato et al. . | |
| 4,377,245 | 3/1983 | Patty | 220/336 |
| 4,510,176 | 4/1985 | Cuthbert et al. | 118/52 |
| 4,528,934 | 7/1985 | Muneo . | |
| 4,550,679 | 11/1985 | Pipa et al. | 118/52 |
| 5,009,818 | 4/1991 | Arai et al. . | |
| 5,099,469 | 3/1992 | Dobbin et al. . | |
| 5,270,150 | 12/1993 | Oishi et al. . | |
| 5,344,682 | 9/1994 | Mizukuki et al. . | |
| 5,518,134 | 5/1996 | Liu | 220/336 |

FOREIGN PATENT DOCUMENTS

| | | |
|---|---|---|
| 62-140674 | 6/1987 | Japan . |
| 7022361 | 1/1995 | Japan . |
| 63076431 | 6/1995 | Japan . |

*Primary Examiner*—Donald E. Czaja
*Assistant Examiner*—Michael P. Colaianni
*Attorney, Agent, or Firm*—Edgar H. Haug

[57] ABSTRACT

An apparatus for the spin coating of substrates including a substrate carrier, a motor for rotating the substrate carrier, and a spinning bowl surrounding the substrate carrier. A lid is also provided in this spin coating apparatus which at least partially covers the spinning bowl for diminishing the escape for fumes into the ambient atmosphere during the spin coating of a substrate carried by the substrate carrier. The lid is also designed for improving the air flow around the substrate carried by the substrate carrier during the spin coating of the substrate.

5 Claims, 2 Drawing Sheets

COMPACT DISC SPIN COATER

FIELD OF THE INVENTION

This invention relates generally to the fabrication of compact discs and more particularly to an improved spin coating apparatus and method.

BACKGROUND OF THE INVENTION

Compact discs or CDs are currently manufactured in a relatively complex process in which the information on the CD is first obtained for instance from a digital source. A premastering disc is created in a photo lithographic process which lays down the information in a spiral pattern. From the premastering disc, a master stamping disc is formed in an electroplating process. The master stamping disc is then used to hot stamp thermoplastic discs with the grooves or interstices which carry the information from the premastering disc.

Following the molding of the discs, the discs are "metalized" by placing them, via a vacuum lock, into a vacuum chamber where a thin coat of aluminum is deposited over the physical patterning on the surface of the disc ("substrate") using a sputtering device comprising a magnetron. After metalization, the discs are spin coated to cover the metal with a protective coating such as lacquer. This is usually followed by an inspection step.

The present processing of compact disks requires continuous processing along an efficient flow path to take the discs from start to finish, so that more than 1,000 discs per hour can be manufactured. In the course of developing systems capable of this throughput speed, compromises have been made. For example, the spin coating of compact disks (substrates) is carried out in an open-top spinning bowl that allows the rapid placement of the disk in the bowl by mechanical means.

The ordinary open-top spinning bowl arrangement has several drawbacks. First, the toxic fumes from the protective coating material are released into the atmosphere. Second, because of the air flow in and around the open-top spinning bowl, particles of the protective coating material can be pulled out of the bowl away from the disk to be coated resulting in unacceptable end products. This is due to the turbulence created by the airflow and the resulting area of partial vacuum located over the middle portion of the spinning substrate. Finally, the open-top bowl permits dust and other contaminants to come into contact with the coating material before it dries to thereby degrade the end products.

SUMMARY OF THE INVENTION

The present invention is an improved spin coater which, incorporates a movable lid member above the open-top of the spinning bowl which contains the toxic fumes and improves the air flow such that small particles of the coating material do not escape from the bowl, and minimizes the possibility of dust and other contaminants contacting the coating material before it dries.

In a preferred embodiment of the present invention the movable lid member comprises two semicircular sections each pivotally mounted on an end support post. The two sections come together to form a lid with a small central hole. The lid member is mounted such that it is as close to the spinning bowl as possible without actually contacting it.

In use, the present invention serves to maintain the toxic fumes of the coating material substantially in the spinning bowl. It also improves the air flow in and around the substrate being coated because the small central hole functions to limit and direct the flow of air into the spinning bowl in more direct, less turbulent manner.

BRIEF DESCRIPTION OF THE DRAWINGS

These and other features of the subject invention will be better understood in conjunction with the Detailed Description taken in conjunction with the Drawings of which.

DETAILED DESCRIPTION

Figure 1:
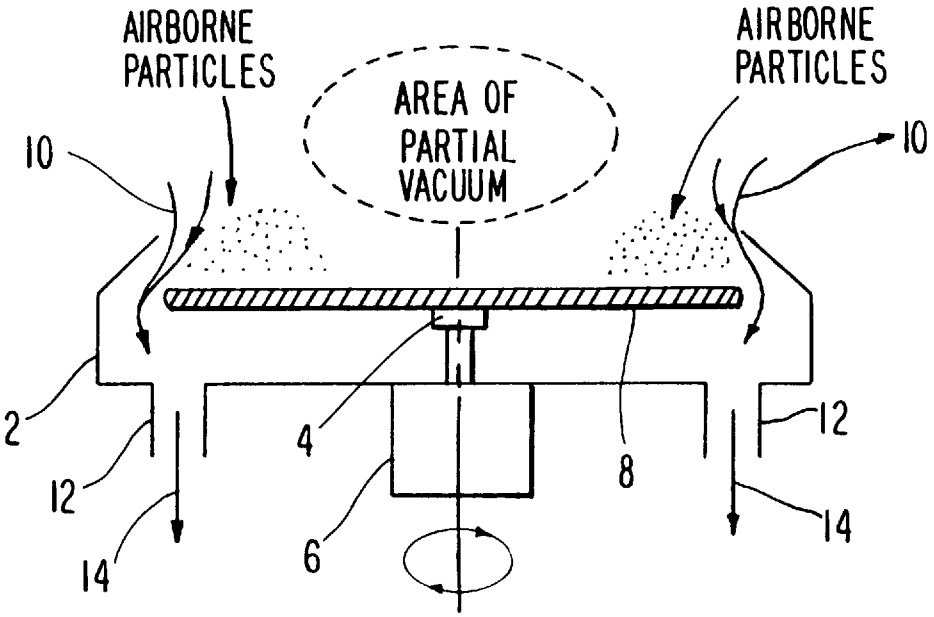
FIG. 1 PRIOR ART
FIG. 1 is a cross-sectional view of a prior art spin coating device for the coating of compact discs.

Referring now to FIG. 1, prior art spin coaters generally comprise a spinning bowl 2, a substrate carrier 4 and a motor 6 for rotating the disk or substrate 8. When the substrate 8 is spun at high velocity, the air inflow is as shown by arrows 10. The outflow is through exhaust ports 12 along arrows 14. This design results in the formation of an area of partial vacuum over the center of the disk because of the direction and turbulence of the airflow. This, in turn, causes or permits the presence of airborne particles of the liquid coating material to hover over the disk and/or leave the spinning bowl which causes diminished end product quality. This also results in toxic fumes being released into the ambient atmosphere.

Figure 2:
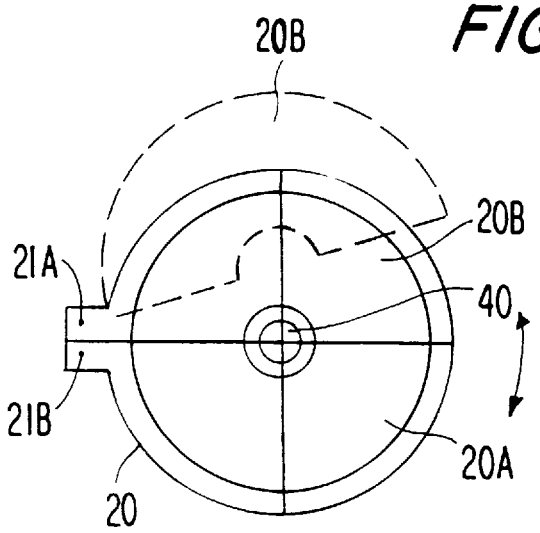
FIG. 2 is a top plan view of the lid member of the present invention.
Figure 3:
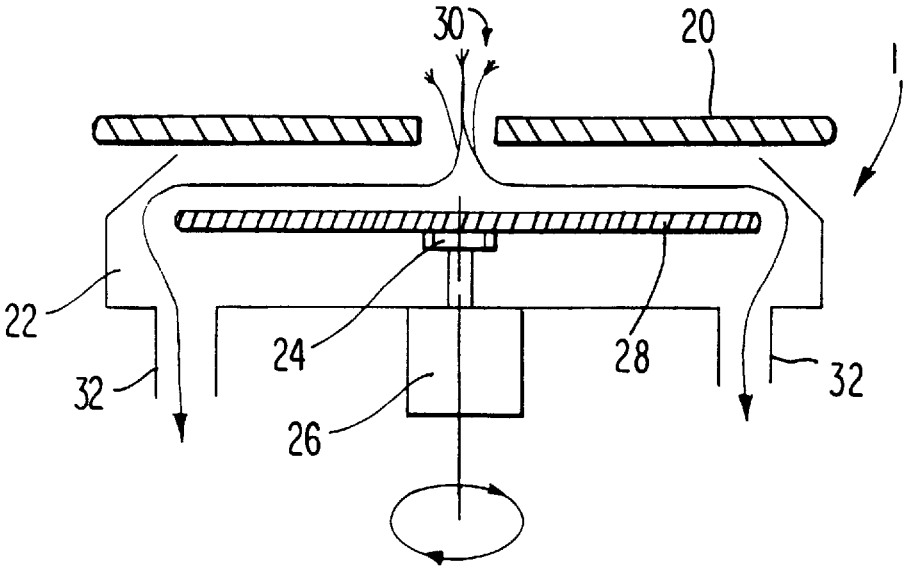
FIG. 3 is a cross-sectional view of the spin coater of the present invention.

As shown in FIGS. 2 and 3, the present invention 1 incorporates an lid member 20, which acts, in part, as a cover over the spinning bowl 22. The lid member is preferably split into two portions 20A and 20B each pivotally mounted on a support post 21A and 21B, to provide easy access to the spinning bowl 22. As in prior art devices, the present invention includes a substrate carrier 24 and a motor 26 to impart rotation to the substrate 28. It also includes exhaust outlets 32.

The small central hole 40 in the lid member 20, acts to modify the air inflow 30 resulting in less turbulent air flow. With the modified airflow, few or no airborne particles are present such that the quality of the end product is more consistently of high quality. The lid member 20 itself, together with the improved airflow, prevent the vast majority of the toxic fumes from escaping out of the spinning bowl (other than through exhaust outlet 32) into the ambient air.

While reference has been made to certain preferred embodiments of the present invention, these are meant as illustrative only and it will occur to those skilled in the art that modifications can be made without departing from the spirit or intent of the invention.

We claim:

1. An apparatus for the spin coating of substrates comprising:

means for carrying a substrate;

motor means for rotating said substrate carrier means;

a spinning bowl surrounding said substrate carrier means; and a lid member at least partially covering said spinning bowl for diminishing the escape of fumes into the ambient atmosphere during the spin coating of a substrate carried by said substrate carrier means wherein said lid member comprises two semi-circular portions having semi-circular openings therein which are pivotally mounted on a support post and are movable between an opened position, wherein said semi-circular portions are moved away from each other to expose said spinning bowl, and a closed position, wherein said semi-circular portions are moved into alignment with each other such that said semi-circular openings form an aperture which thereby modifies air flow through said spinning bowl and prevents toxic fumes from escaping out of said spinning bowl.

2. An apparatus according to claim 1 wherein each of said semi-circular openings of said two semi-circular portions are of equal dimensions.

3. An apparatus according to claim 2, wherein said aperture in said lid member is in the center.

4. An apparatus for the spin coating of substrates comprising:

a substrate carrier;

a motor for rotating said substrate carrier;

a spinning bowl surrounding said substrate carrier; and a lid member at least partially covering said spinning bowl for improving the air flow around a substrate carried by said substrate carrier during the spin coating of said substrate wherein said lid member comprises two semi-circular portions having semi-circular openings therein which are pivotally mounted on a support post and are movable between an opened position, wherein said semi-circular portions are moved away from each other to expose said spinning bowl, and a closed position, wherein said semi-circular portions are moved into alignment with each other such that said semi-circular openings form an aperture which thereby modifies air flow through said spinning bowl and prevents toxic fumes from escaping out of said spinning bowl.

5. An apparatus according to claim 4, wherein said aperture is formed in the center of said lid member when said lid member is in its closed position.

* * * * *